US009038221B2

(12) United States Patent
Fraser

(10) Patent No.: US 9,038,221 B2
(45) Date of Patent: May 26, 2015

(54) CELLULAR CUSHIONS INCLUDING SUPPORT MATERIAL AND METHODS OF FABRICATING SAME

(71) Applicant: Star Cushion Products, Inc., Freeburg, IL (US)

(72) Inventor: Janice Geraldine Fraser, Belleville, IL (US)

(73) Assignee: Star Cushion Products, Inc., Freeburg, IL (US)

( * ) Notice: Subject to any disclaimer, the term of this patent is extended or adjusted under 35 U.S.C. 154(b) by 0 days.

(21) Appl. No.: 13/770,044

(22) Filed: Feb. 19, 2013

(65) Prior Publication Data

US 2014/0230153 A1 Aug. 21, 2014

(51) Int. Cl.

| | |
|---|---|
| ***A47C 16/00*** | (2006.01) |
| ***A61G 5/10*** | (2006.01) |
| ***A47C 27/18*** | (2006.01) |
| ***A47C 7/18*** | (2006.01) |
| ***A61G 7/057*** | (2006.01) |

(52) U.S. Cl.

CPC ..... *A61G 5/1043* (2013.01); *Y10T 29/481* (2015.01); *Y10T 156/10* (2015.01); *A47C 27/18* (2013.01); *A47C 7/18* (2013.01); *A61G 7/05769* (2013.01); *A61G 2005/1045* (2013.01)

(58) Field of Classification Search

CPC ..... A47C 7/021; A47C 27/081; A47C 27/15; A47C 27/10; A47C 7/022; A47C 27/148; A47C 27/18; A47C 27/088; A47C 23/002; A47C 27/056; A61G 5/1043; A61G 7/05776; A61G 7/05769; A61G 2005/1045; A61G 7/05715; A61G 7/1021

USPC ..... 5/653, 654, 655.3, 655.9, 657

See application file for complete search history.

(56) References Cited

U.S. PATENT DOCUMENTS

| | | | | | |
|---|---|---|---|---|---|
| 3,017,642 | A | * | 1/1962 | Rosenberg et al. | 5/709 |
| 4,005,236 | A | * | 1/1977 | Graebe | 428/72 |
| 4,371,997 | A | * | 2/1983 | Mattson | 5/709 |
| 4,541,136 | A | * | 9/1985 | Graebe | 5/655.3 |
| 4,698,864 | A | * | 10/1987 | Graebe | 5/654 |
| 4,753,480 | A | * | 6/1988 | Morell | 297/452.27 |
| 4,828,325 | A | | 5/1989 | Brooks | |

(Continued)

FOREIGN PATENT DOCUMENTS

EP 0724396 B1 3/2000

OTHER PUBLICATIONS

International Search Report, dated Jun. 11, 2014, for co-pending International Application No. PCT/US2014/017123 (22 pgs.).

*Primary Examiner* — Timothy D Collins
*Assistant Examiner* — Richard G Davis
(74) *Attorney, Agent, or Firm* — Armstrong Teasdale LLP

(57) ABSTRACT

A cellular cushion includes a base, a plurality of hollow cells, and support material. The base includes at least a first layer and a second layer. The plurality of hollow cells are coupled to, and extend outward from, only one of the first layer and the second layer. Each of the plurality of cells extends from a root defined at only one of the first layer and the second layer outwardly to an outer end. The plurality of cells are coupled together in flow communication via a plurality of channels extending between the cells. The support material is inserted within at least one of the hollow cells. The second layer coupled to the first layer such that the support material is between an inner surface of said at least one of the hollow cells and the second layer.

16 Claims, 5 Drawing Sheets

(56) References Cited

U.S. PATENT DOCUMENTS

| | | | | | |
|---|---|---|---|---|---|
| 4,860,397 | A | | 8/1989 | Gusakov | |
| 5,052,068 | A | * | 10/1991 | Graebe | 5/654 |
| 5,111,544 | A | * | 5/1992 | Graebe | 5/654 |
| 5,152,023 | A | * | 10/1992 | Graebe | 5/655.3 |
| 5,163,196 | A | * | 11/1992 | Graebe et al. | 5/654 |
| 5,274,846 | A | | 1/1994 | Kolsky | |
| 5,533,220 | A | * | 7/1996 | Sebag et al. | 5/654 |
| 5,613,257 | A | * | 3/1997 | Graebe | 5/654 |
| 5,638,565 | A | * | 6/1997 | Pekar | 5/710 |
| 5,689,845 | A | * | 11/1997 | Sobieralski | 5/654 |
| 6,598,251 | B2 | | 7/2003 | Habboub et al. | |
| 6,623,080 | B2 | * | 9/2003 | Clapper | 297/452.41 |
| 6,782,574 | B2 | | 8/2004 | Totton et al. | |
| 6,901,617 | B2 | | 6/2005 | Sprouse, II et al. | |
| 7,223,461 | B2 | * | 5/2007 | Kannankeril et al. | 428/166 |
| 7,434,282 | B2 | * | 10/2008 | Fraser et al. | 5/654 |
| 7,757,321 | B2 | * | 7/2010 | Calvert | 5/657 |
| 7,996,940 | B1 | | 8/2011 | Dahm et al. | |
| 8,011,045 | B2 | | 9/2011 | Skripps | |
| 8,621,693 | B2 | * | 1/2014 | Wyatt et al. | 5/713 |
| 2004/0237201 | A1 | | 12/2004 | Fraser et al. | |
| 2007/0283496 | A1 | * | 12/2007 | Skripps | 5/654 |
| 2008/0078033 | A1 | * | 4/2008 | Wyatt et al. | 5/727 |
| 2009/0205138 | A1 | * | 8/2009 | Chen et al. | 5/691 |
| 2012/0090095 | A1 | * | 4/2012 | Fraser | 5/655.3 |
| 2012/0131752 | A1 | * | 5/2012 | Mason | 5/652.1 |

* cited by examiner

CELLULAR CUSHIONS INCLUDING SUPPORT MATERIAL AND METHODS OF FABRICATING SAME

BACKGROUND OF THE INVENTION

This invention relates generally to cellular cushions, and more particularly, to cellular cushions that include support material.

Individuals confined to wheelchairs may run the risk of tissue breakdown and the development of pressure sores, all of which may be extremely dangerous and difficult to cure. More specifically, because such individuals may primarily be in a seated position for extended periods of time, their weight may be concentrated in the bonier portions of the individual's buttocks. Over time, blood flow to such areas may decrease, causing tissue to break down.

To reduce the weight concentration of such individuals, at least some known wheelchairs use cellular cushions that facilitate distributing the individual's weight over a larger area and across the individual's buttocks, and that decreasing their weight concentration in smaller areas. At least some known cellular cushions include a plurality of hollow fluid-filled cells that project upwardly from a common base. More specifically, because the air-filled cells are coupled in flow communication through the base, the air within such cells is at the same pressure throughout the plurality of cells, and as such, each cell exerts the same pressure against an individual's buttocks.

Because all of the cells are at the same pressure across the base, the plurality of cells may provide less stability to the seated individual in comparison to a substantially planar seating surface. To increase the stability of the user, at least some cushions enable the user to control their immersion depth into the cushion and/or their relative position on the cushion by varying the pressure of the air in the cells or in a zone of cells. By varying the pressure in the cells or in a zone of cells, the user may be able to increase their stability on the cellular cushion and/or selectively change their posture on the cushion. Although the pressure in the cells may be varied, the general contour of the cushion remains the same.

To provide additional support and stability to users, at least some cellular cushions are fabricated with cells that are formed with various heights or cells that include a contoured outer surface. The cells in such cushions are oriented in an arrangement that defines a contoured seating surface for the user. Moreover, the seating surface remains contoured as the immersion depth is varied by the user. However, depending on the user, such as those users having deformities (skeletal or otherwise) or those that lack muscular strength in their pelvis and/or thigh regions, portions of the user may bottom out (i.e., fully compress the cells) if the pressure in the cells is decreased in cellular cushions. Moreover, cellular cushions including cells of varying heights and/or cells having contoured outer surfaces is generally more difficult and costly to manufacture.

BRIEF DESCRIPTION OF THE INVENTION

In one aspect, a cellular cushion is provided. The cellular cushion includes a base, a plurality of hollow cells, and support material. The base includes at least a first layer and a second layer. The plurality of hollow cells are coupled to, and extend outward from, only one of the first layer and the second layer. Each of the plurality of cells extends from a root defined at only one of the first layer and the second layer outwardly to an outer end. The plurality of cells are coupled together in flow communication via a plurality of channels extending between the cells. The support material is inserted within at least one of the hollow cells. The second layer coupled to the first layer such that the support material is between an inner surface of said at least one of the hollow cells and the second layer.

In another aspect a cellular cushion is provided. The cushion includes a flexible base including at least one layer, a plurality of hollow cells extending outward from, only one of the base plurality of layers, support material, and a sealing layer. The plurality of cells include at least a first cell, a second cell, and a third cell coupled together in flow communication with each other via a plurality of hollow channels, such that the second cell is between the first and third cells. The support material is inserted within at least the first cell. The sealing layer is coupled to the base such that the support material is contained within the first cell.

In a further aspect, a method of fabricating a cellular cushion is provided. The method comprises forming a first base layer including a plurality of hollow cells that extend outward from the first base layer and that are each coupled together in flow communication via a plurality of channels extending between adjacent hollow cells, and inserting support material into at least one of the plurality of cells. The method also comprises coupling a second layer to the first layer such that the plurality of channels are aligned substantially in the same plane and such that the support material is contained in the cell without the support material being coupled to the second layer.

DETAILED DESCRIPTION OF THE INVENTION

Figure 1:
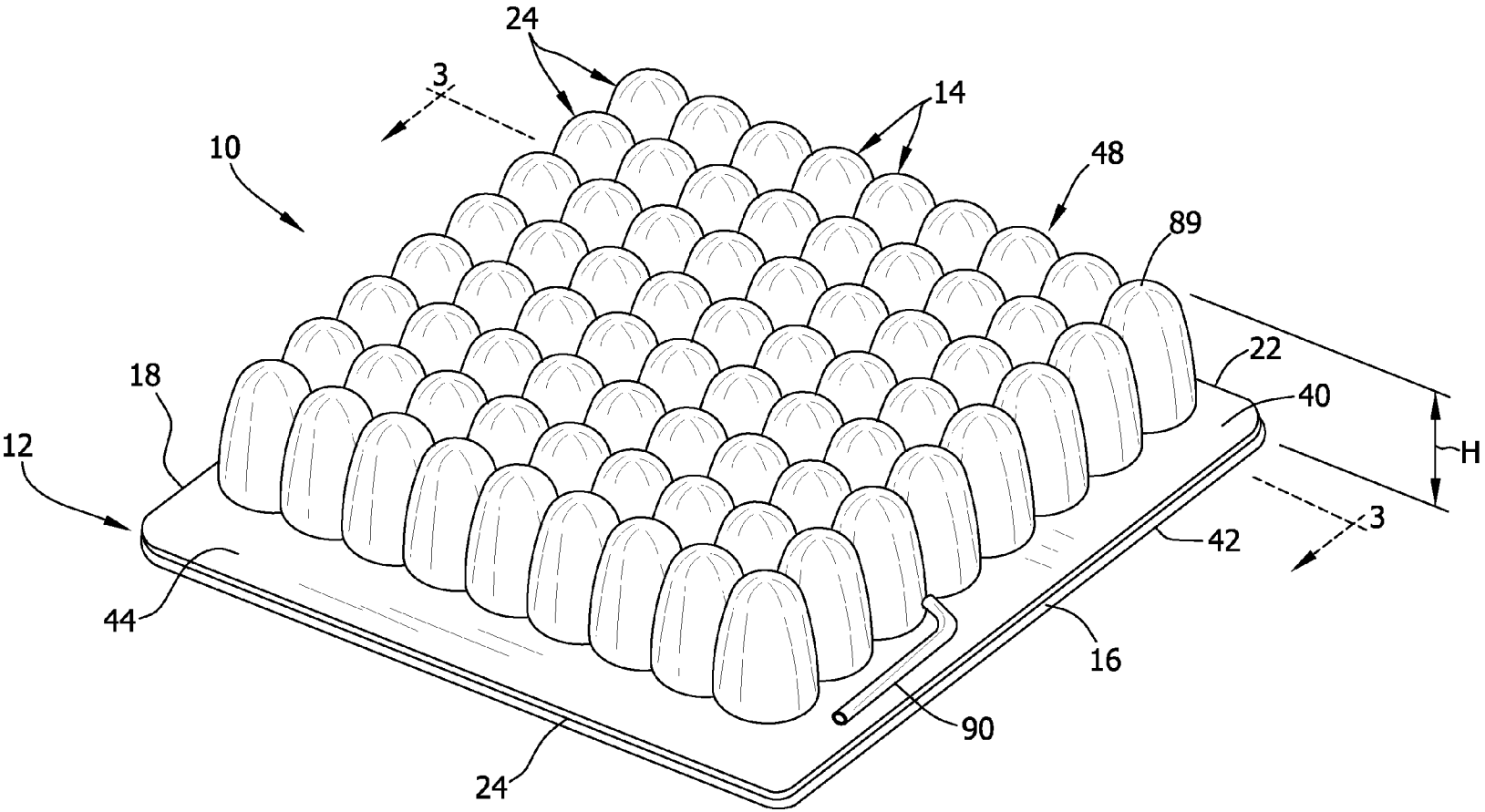
FIG. 1 is a perspective view of an exemplary cellular cushion.
Figure 2:
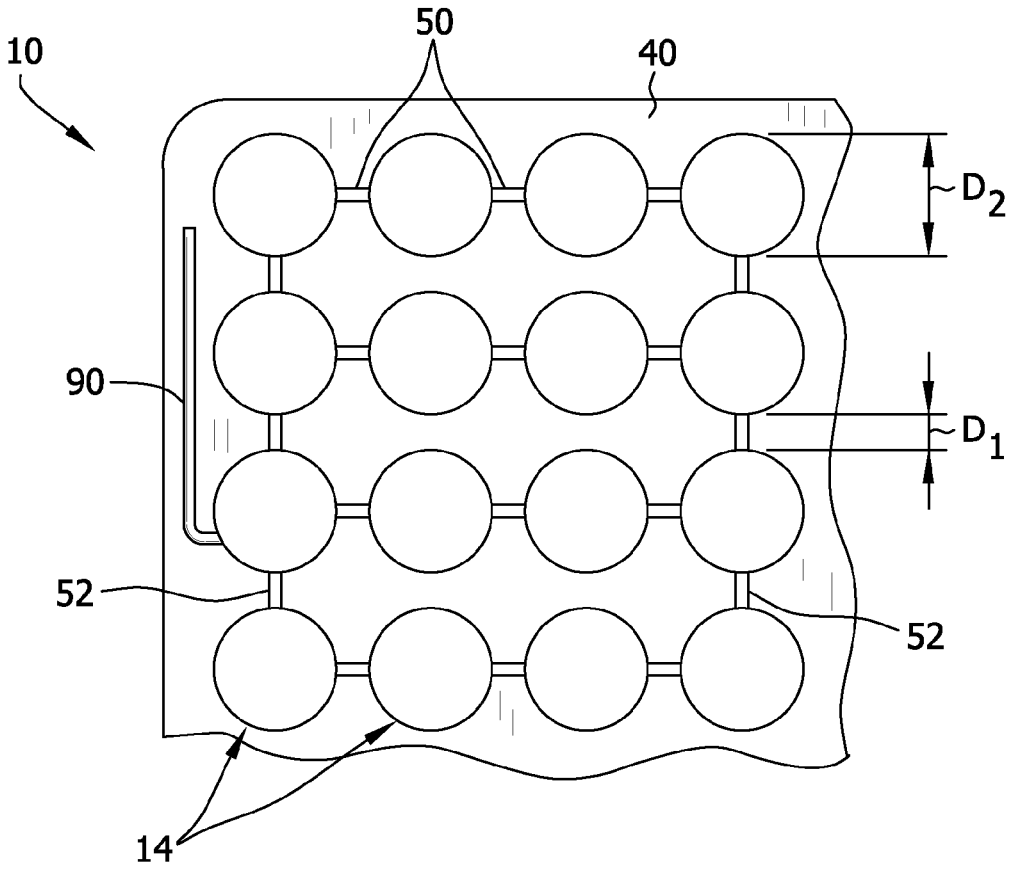
FIG. 2 is a plan cross-sectional view of a portion of the cellular cushion shown in FIG. 1.
Figure 3:
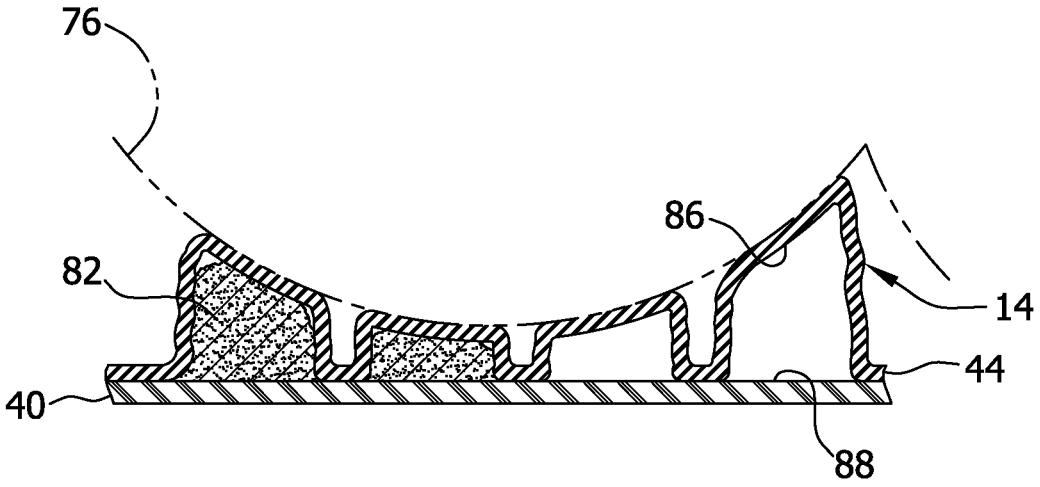
FIG. 3 is a cross-sectional view of a portion of the cellular cushion shown in FIG. 2 and taken along line 3-3.
Figure 4:
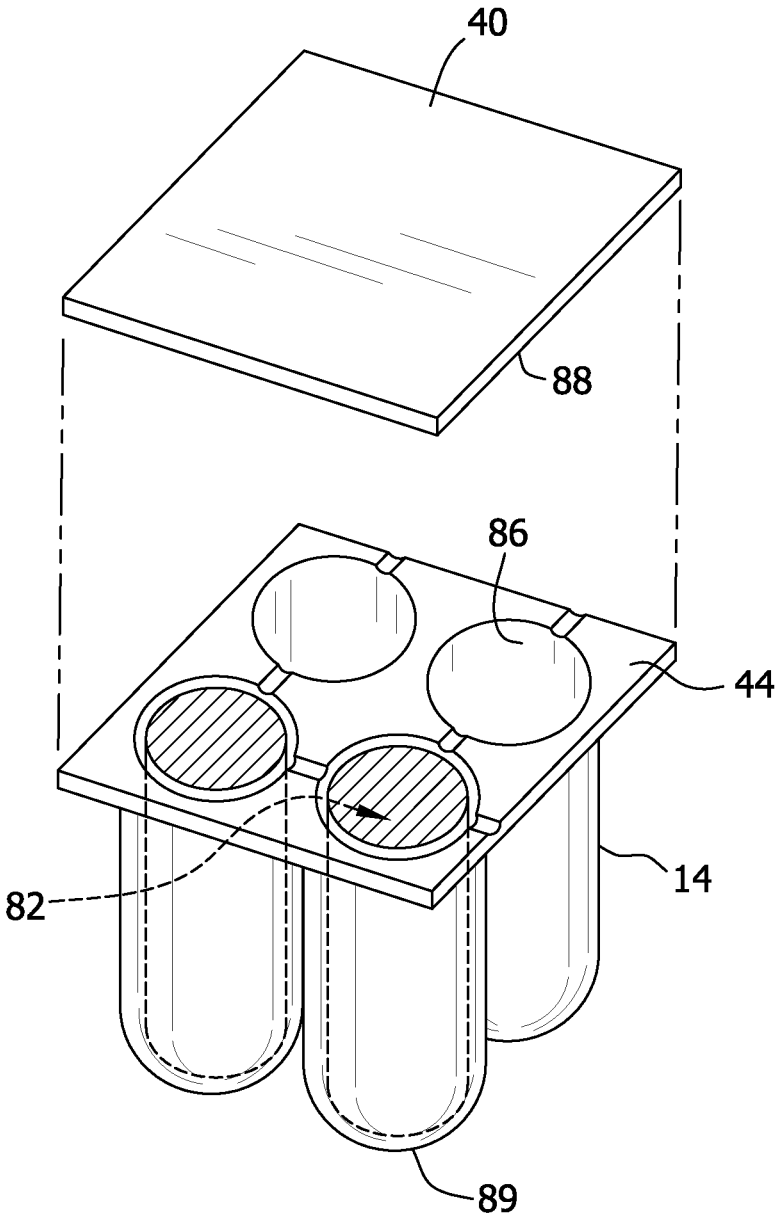
FIG. 4 is an exploded view of the cellular cushion shown in FIG. 1, and viewed from the bottom side of the cellular cushion.
Figure 5:
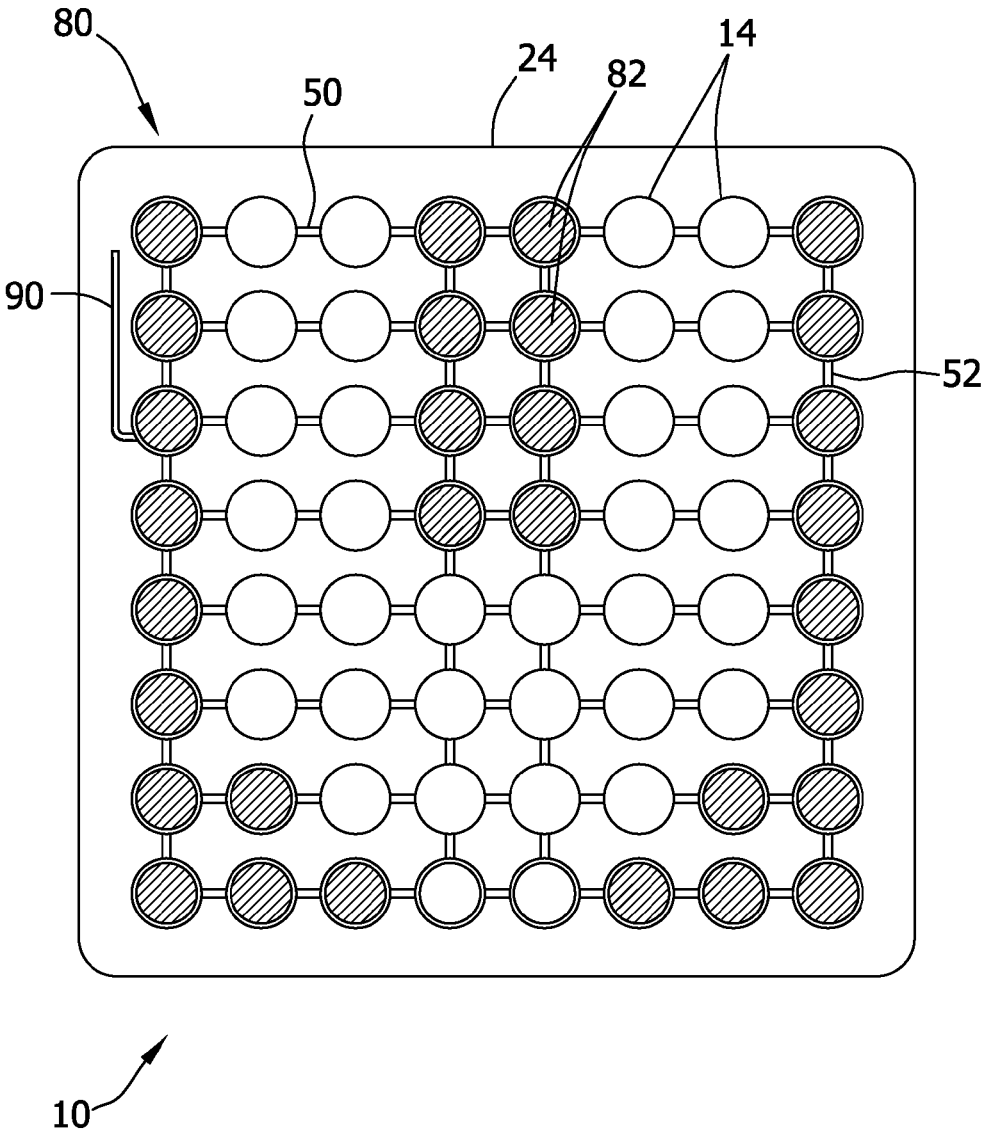
FIG. 5 is a plan view of the cellular cushion shown in FIG. 1 and including an exemplary orientation of support material.

FIG. 1 is a perspective view of an exemplary cellular cushion 10. FIG. 2 is a plan cross-sectional view of a portion of cellular cushion 10. FIG. 3 is a cross-sectional view of a portion of cellular cushion 10. FIG. 4 is an exploded view of cellular cushion 10. FIG. 5 is a plan view of cellular cushion 10 and including an exemplary orientation 80 of support material 82. Cushion 10 is flexible and as described herein, is configured for use on an underlying support surface, such as, but not limited to a chair seat, a mattress, or a wheelchair. Cushion 10 includes a base 12 and a plurality of hollow cells 14. In the exemplary embodiment, base 12 is substantially rectangular and includes a forward side 16 and a rear side 18 connected together by a pair of opposing sides 20 and 22. In another embodiment, base 12 is non-rectangular. In a further embodiment, base 12 may have any shape that enables cushion 10 to function as described herein.

In the exemplary embodiment, cells 14 are arranged in a plurality of rows 24 which extend substantially across base 12 between sides 20 and 22, and between forward and rear sides 16 and 18, respectively. In an alternative embodiment, cells 14 may be arranged in any other geometric configurations, other than rows 24, that enables cushion 10 to function as described herein.

Base 12 is flexible and is formed from a plurality of layers 30 that are coupled together. In one embodiment, base 12 and cells 14 are formed from a flexible neoprene. Alternatively, base 12 and cells 14 may be formed from any non-neoprene material or combination of materials that enables cellular cushion 10 to function as described herein. In the exemplary embodiment, an outer layer 40 is coupled to a conformal layer 44 to form base 12, as is described in more detail below. In alternative embodiments, base 12 may include additional layers, such as is described in U.S. Pat. No. 7,434,282 to Fraser.

In the exemplary embodiment, conformal layer 44 is formed unitarily with cells 14 such that cells 14 are coupled together in an arrangement 48 of air cells 14 wherein all cells 14 on layer 44 are coupled together in fluid flow communication with each other, as described in more detail below. In another embodiment, all cells 14 across layer 44 are not all coupled together in fluid flow communication, but rather, layer 44 is defined into regions or quadrants of cells 14 that are coupled together in fluid flow communication with each other, as described in more detail below. Alternatively, cells 14 may be coupled together in any arrangement that enables cushion 10 to function as described herein.

More specifically, in the exemplary embodiment, cells 14 are positioned substantially symmetrically across conformal layer 44 within cell arrangement 48, such that adjacent cells 14 are separated by a substantially equal distance $D_1$. In another embodiment, adjacent cells 14 are separated by variable distances. Alternatively, conformal layer cells 14 may be coupled together in any arrangement and/or orientation with respect to each other.

In the exemplary embodiment, conformal layer 44 is molded with cells 14. In an alternative embodiment, individual cells 14 are coupled integrally to layer 44. In a further alternative embodiment, cells 14 are formed integrally with layer 44 using an injection molding process, a dip molding process, and/or a vacuum molding process, for example. In the exemplary embodiment, cells 14 are all identical and each has an identical height H and because each is substantially circular, each has an identical diameter $D_2$. Alternatively, a plurality of different-sized or shaped cells may extend from base 12.

A plurality of channels 50 extend between adjacent cells 14 to couple cells 14 together in flow communication. More specifically, in the exemplary embodiment, channels 50 are arranged in generally flowpaths that extend generally laterally across cushion 10 through each row 24 of cells 14. Each laterally-oriented channel 50 extending through each row 24 is then coupled in flow communication with every other channel 50 via at least one channel 52 extending axially across cushion 10. In an alternative embodiment, channels 50 may be oriented in X-shaped patterns that extend between four adjacent cells 14. Alternatively, channels 50 may extend between any number of cells 14, such as two, and in any orientation that enables cushion 10 to function as described herein.

Channels 50 are coupled in sealing contact with conformal layer 44. In one embodiment, channels 50 are coupled to layer 44 using a silk screening process. In another embodiment, channels 50 are formed integrally with conformal layer 44. In a further embodiment, channels 50 are coupled to layer 44 using an X-Y printing machine process. In yet another embodiment, channels 50 are coupled to layer 44 using an adhesive process. In a further embodiment, channels 50 are formed using a liquid gasket process. In another embodiment, channels 50 are formed using a spray process. Alternatively, channels 50 may be coupled to layer 44 using any other process that enables channels 50 to couple to layer 44 such that adjacent cells 14 are coupled together in flow communication and such that cushion 10 functions as described herein.

In the exemplary embodiment, a release agent is contained within each channel 50. The release agent facilitates ensuring that channels 50 remain substantially unobstructed during the assembly of cushion 10, such that adjacent cells 14 remain in fluid flow communication. More specifically, and as described in more detail below, during assembly of cushion 10, the release agent ensures that adjacent cushion layers 30 remain separated to define channels 50. In the exemplary embodiment, the release agent is formed of a low viscous solution. In another embodiment, the release agent is any solution that performs as described herein, and more specifically, prevents the bonding together of layers 40 and 44, such as, but not limited to, petroleum-based mixtures.

When layer 40 is coupled to conformal layer 44, layer 40 mates in sealing contact with areas of conformal layer 44 that extend between adjacent cells 14, and around an outer perimeter of each cell 14. More specifically, when layer 40 is coupled to layer 44, channels 50 are properly oriented relative to cells 14. The release agent prevents layer 40 from sealing against conformal layer 44 in areas defined by channels 50, such that, as described in more detail below, fluid flow between layers 40 and 44 is only possible through channels 50.

In the exemplary embodiment, at least some cells 14 include a support material 82 contained therein. More specifically, in the exemplary embodiment, material 82 is inserted into specific cells 14 in a specified orientation 80 during fabrication prior to conformal layer 44 being coupled to layer 40. In the exemplary embodiment, support material 82 is not coupled to conformal layer 44 or to layer 40, but rather material 82 is merely contained between an inner surface 86 of each respective cell 14 and an upper surface 88 of layer 40. As such, material 82 may "float freely" or shift within each respective cell 14 that it is contained in after layer 40 is securely coupled to layer 44. Moreover, because material 82 is not coupled to layer 40, material 82 does not affect inflation or deflation of cells 14.

Support material 82 facilitates ensuring optimal pressure distribution across cushion 10 and provides increased stability and support to selected areas 80 of cushion 10. More specifically, support material orientation 80 is variable during fabrication of cushion 10 to facilitate providing additional comfort to the user 76 and to selectively vary the ergonomics and contour of the seating surface defined by cells 14. It should be noted that support material 82 may be inserted in any cells 14 and in any orientation that enables cushion 10 to function as described herein. For example, in one embodiment, support material 82 is inserted in each cell 14 on cushion 10.

Support material 82 can be formed of a variety of materials, including open-celled or closed-celled foam, rubberized material, polyurethane, gels, fluids, and/or combinations of materials. Material 82 is resiliently deformable to some extent and is capable of flexing and/or deflecting substantially independently of the deflection of cells 14 in response to compressive forces being applied to cushion 10 by a user 76. In the exemplary embodiment, material 82 is a foam material that is formed in a generally cylindrical shape and that is sized to be inserted into cells 14 within orientation 80. In other embodiments, material 82 may be a gel or fluid that is injected into cells 14. Alternatively, material 82 may have any shape that enables cushion 10 to function as described herein. For example, material 82 may have a cross-sectional shape that is different than a shape of cells 14, such that a user 76 a contour of the seated surface of cushion 10 may change and be defined by material 82, rather than by cells 14, as the immersion depth of the user 76 is increased. In another embodiment, material 82 is formed into a plurality of pellets that are inserted into cells 14. In a further embodiment, material 82 is formed in a honeycombed shape. Alternatively, any material 82, having any shape, including a plurality of different shapes, may be inserted into cells 14, that ensures that cushion 10 functions as described herein.

In the exemplary embodiment, material 82 is fabricated from a uniform foam material and all of material 82 within cushion 10 is the same material. Alternatively, any material 82 inserted within cushion 10 and/or within any individual cell 14, may be fabricated from a plurality of different materials and/or in a plurality of different shapes. For example, in one embodiment, material 82 is fabricated from cylindrical columns that include at least two different materials such that a density and a firmness of each column of material 82 are greater adjacent to layer 40 as opposed to adjacent to an outer end 89 of each cell 14. Material 82 enables a contour of the seating surface defined by cushion 10 to be variably changed. Moreover, material 82 also facilitates preventing a user 76 from bottoming out a pressure of cells 14 across cushion 10 is decreased.

In one embodiment, cushion 10 includes an immersion warning system (not shown) that includes at least one sensor that provides an indication to the user 76 that a portion of cushion 10 is close to bottoming out, or has bottomed out. For example, the warning system may provide a visual indication, i.e., a light that illuminates, or an audible alarm that sounds, when a user has bottomed out on cushion 10 and pressure in cells 14 needs to be increased. In another embodiment, the warning system includes a green light that indicates the cushion immersion depth is satisfactory, a yellow light that indicates that the pressure in the cushion 10 should not be decreased, and a red light that indicates that a portion of the cushion 10 has bottomed out. In other embodiments, the warning system may provide an audible alarm, a visual alarm, or a combination of those and other alarms to the user 76 that user 76 has bottomed out within cushion 10 or within a zone defined within cushion 10.

In the exemplary embodiment, base 12 also includes at least one inflation/deflation valve 90 that extends from base 12. Valve 90 is known as a cushion valve and is coupled in flow communication to cells 14 through channels 50. Specifically, valve 90 may be selectively opened and closed to enable fluid to be injected into, or discharged from, cells 14. More specifically, because layer 40 is coupled to conformal layer 44 except at channels 50, airflow is possible between layers 44 and 40 through channels 50 and into cells 14. Accordingly, in the exemplary embodiment, because cells 14 are coupled together in flow communication, when cells 14 are initially inflated, and prior to a user 76 being seated on cushion 10, cells 14 are each pressurized to approximately the same fluid pressure. In the exemplary embodiment, the working fluid supplied to cells 14 is air. In an alternative embodiment, the working fluid is any fluid that enables cushion 10 to function as described herein, including, but not limited to, other gases, fluids, or liquids.

In an alternative embodiment, cushion 10 is supplied to the user 76 as a totally enclosed cushion that is pre-pressurized and does not include valve 90. Although cushion 10 provides a sitting surface for a seat, in a further alternative embodiment, cushion 10 is used for other cushioning purposes.

During use, in the exemplary embodiment, initially cushion 10 is inflated by introducing air through valve 90 into channels 50 and cells 14. Moreover, in the exemplary embodiment, cells 14 are pressurized substantially equally across cushion 10 and each cell 14 is inflated to have a generally circular cross-sectional profile. In an alternative embodiment, cells 14 have a non-circular cross-sectional profile. In a further alternative embodiment, layer 44 is defined into regions or quadrants of cells 14 that are coupled together in fluid flow communication with each other, and cells 14 within each region or quadrant are inflated to substantially the same fluid pressure. Specifically, the fluid pressure of each cell 14 is variably selectable by the seated user 76 based on comfort and/or seated immersion requirements, and is adjustable by either adding additional air, or opening valve 90 to decrease the pressure in cells 14. More specifically, as cells 14 are inflated, adjacent cells 14 contact each other, such that cells 14 form a generally continuous, and highly displaceable, supporting surface that is highly conformable to the seated user 76.

When all of the cells 14 are inflated together, which is normally the case, the sides of adjacent cells 14 contact each other and form a generally continuous, but highly displaceable, supporting or seating surface. Moreover, in the exemplary embodiment, because cushion 10 is cellular, the weight of the seated user 76 is distributed broadly with decreasing peak pressures across the entire area of the user's buttocks and therefore, cushion 10 dissipates pressures resulting from the weight supported at the ishia, or bony prominences of the user's buttocks.

A user 76 may selectively adjust their immersion depth within cushion 10 by opening valve 90 and either increasing the pressure within cells 14 or decreasing the pressure within cells 14. When valve 90 is opened to increase the immersion depth of the user 76 within cushion 10, in the exemplary embodiment, because cells 14 are each coupled together in flow communication, the pressure within all cells 14 across cushion 10 is decreased uniformly. Depending on the amount and/or size of material 82, eventually the user will at least be partially supported by material 82 in addition to cells 14. Accordingly, material 82 forms a secondary support for the user 76. Moreover, depending on orientation 80 and a size and shape of cells 14 and material 82, the contour of the seating surface defined by cushion 10 may be changed and defined by a combination of cells 14 and material 82, and/or predominately by material 82, rather than only by cells 14. Furthermore, material 82 facilitates preventing the user 76 from bottoming out on cushion 14, while increasing the stability to the user 76.

The above-described cellular cushions provide a user with a sitting surface that is selectively controllable to facilitate increasing stability and comfort to the user, as well as enabling a user to change their relative position on the cushion and/or to change their posture relative to the cushion. More specifically, the cellular cushions each include a conformal layer that includes a plurality of cells extending therefrom, wherein each cell extending from the conformal layer is coupled in flow communication with every other cell extending from the conformal layer. Furthermore, each cellular cushion includes support material inserted in selected cells that provide additional support to the user and that prevent the user from bottoming out. The support material also enables the contour defined by the seating surface to be changed as the operating pressure within the cells is changed. As a result, a cellular cushion is provided which facilitates increasing the sitting support and stability provided to a seated user in a cost-effective and reliable manner.

Exemplary embodiments of cellular cushions are described above in detail. Although the cellular cushions are herein described and illustrated in association with seated users, it should be understood that the present invention may be used to provide cushioning in a plurality of other uses. Moreover, it should also be noted that the components of each cellular cushion are not limited to the specific embodiments described herein, but rather, aspects of each cushion and fabrication method may be utilized independently and separately from other methods described herein.

While the invention has been described in terms of various specific embodiments, those skilled in the art will recognize that the invention can be practiced with modification within the spirit and scope of the claims.

What is claimed is:

1. A cellular cushion comprising:

a base comprising at least a first layer and a second layer;

a plurality of hollow cells coupled to, and extending outward from, only one of said first layer and said second layer, each of said plurality of cells extends from a root defined at only one of said first layer and said second layer outwardly to an outer end, said plurality of cells coupled together in flow communication via a plurality of channels extending between said cells; and support material inserted within at least one of said hollow cells, said second layer coupled to said first layer such that said support material is between an inner surface of said at least one of said hollow cells and said second layer, wherein a cross-sectional shape of said support material is different from a cross-sectional shape of said at least one hollow cell, such that a contour of a supporting surface of said at least one hollow cell changes from being defined by said cross-section of said at least one hollow cell to being defined by said cross-section of said support material as an immersion depth of a user is increased.

2. A cellular cushion in accordance with claim 1 wherein said plurality of hollow cells are oriented in rows, said plurality of channels extend between pairs of said hollow cells in adjacent rows, said second layer is sealingly coupled to said first layer.

3. A cellular cushion in accordance with claim 2 wherein said plurality of channels are coupled to at least one of said first layer and said second layer, said plurality of channels are coupled to said base by at least one of a lamination process, a silk screening process, an adhesive process, a liquid gasket process, a spray process, and a printing process.

4. A cellular cushion in accordance with claim 1 wherein said support material is configured to facilitate providing support to a seated user.

5. A cellular cushion in accordance with claim 1 wherein said support material comprises at least one of a gel, a foam material, a fluid, and a flexible material.

6. A cellular cushion in accordance with claim 1 wherein said support material is not coupled to at least one of said first layer and said second layer.

7. A cellular cushion in accordance with claim 1 wherein said support material is configured to move independently of said first and second layers.

8. A cellular cushion in accordance with claim 1 wherein said support material has a cross-sectional shape that is different than a cross-sectional shape of each of said plurality of cells.

9. A cellular cushion in accordance with claim 1 wherein said support material comprises at least a first support material and a second support material, said first support material is inserted in a first of said plurality of cells, said second support material is inserted in a second of said plurality of cells.

10. A cellular cushion in accordance with claim 9 wherein said first support material is different than said second support material.

11. A cellular cushion in accordance with claim 9 wherein said support material comprises at least a first support material and a second support material that are each inserted in at least one of said plurality of cells.

12. A cellular cushion in accordance with claim 1 wherein said support material facilitates preventing a user from bottoming out on said cushion.

13. A cellular cushion in accordance with claim 1 wherein said support material facilitates at least one of controlling an immersion depth of a seated user and controlling a posture of the seated user.

14. A cellular cushion in accordance with claim 1 wherein said outer ends of said plurality of cells define a seat surface of said cushion, said support material is configured to change a contour of said seat surface when a pressure of said plurality of cells is adjusted from a first pressure to a second pressure.

15. A cellular cushion comprising:

a base comprising at least a first layer and a second layer;

a plurality of hollow cells coupled to, and extending outward from, only one of said first layer and said second layer, each of said plurality of cells extends from a root defined at only one of said first layer and said second layer outwardly to an outer end, said plurality of cells coupled together in flow communication via a plurality of channels extending between said cells; and support material inserted within a specified orientation of fewer than all of said hollow cells, wherein the support material comprises at least one of a gel, a foam material, and a flexible material, said remaining cells being void of any support material, said second layer coupled to said first layer such that said support material is between an inner surface of said fewer than all hollow cells and said second layer.

16. A cellular cushion in accordance with claim 15 wherein said specified orientation is selected to increase at least one of a stability and a support of a user.

* * * * *